US008424166B2

(12) United States Patent
Dorneman et al.

(10) Patent No.: US 8,424,166 B2
(45) Date of Patent: Apr. 23, 2013

(54) DUAL LOCKING BAND CLAMP AND METHOD OF FORMING THE SAME

(75) Inventors: Casey James Dorneman, Denver, CO (US); Miklos Balazs Marelin, Auroa, CO (US)

(73) Assignee: Band-It-IDEX, Inc., Denver, CO (US)

( * ) Notice: Subject to any disclaimer, the term of this patent is extended or adjusted under 35 U.S.C. 154(b) by 866 days.

(21) Appl. No.: 12/264,086

(22) Filed: Nov. 3, 2008

(65) Prior Publication Data

US 2009/0144947 A1 Jun. 11, 2009

Related U.S. Application Data

(60) Provisional application No. 60/985,142, filed on Nov. 2, 2007.

(51) Int. Cl.
*F16L 33/00* (2006.01)

(52) U.S. Cl.
USPC ..... 24/20 R; 24/23 B; 24/703.1

(58) Field of Classification Search ..... 24/20 R, 24/23 B, 23 R, 703.1, 30.5 W, 23 W
See application file for complete search history.

(56) References Cited

U.S. PATENT DOCUMENTS

| | | | | |
|---|---|---|---|---|
| 19,709 | A | | 3/1858 | Olmstead |
| 25,125 | A | | 8/1859 | Knowles |
| 43,494 | A | | 7/1864 | Hanvey |
| 51,214 | A | | 11/1865 | Quant |
| 134,052 | A | | 12/1872 | Gurley |
| 155,413 | A | | 9/1874 | Boisseau |
| 188,669 | A | | 3/1877 | Pollard |
| 193,946 | A | * | 8/1877 | Hamilton ..... 24/21 |
| 204,965 | A | | 6/1878 | Gilman |
| 296,686 | A | | 4/1884 | Gresham |
| 356,083 | A | | 1/1887 | Schrader et al. |
| 359,686 | A | | 3/1887 | Noyes |
| 196,432 | A | | 10/1887 | Chapman |
| 980,700 | A | | 1/1911 | Swafford |
| 997,186 | A | | 7/1911 | Flora |
| 1,000,083 | A | | 8/1911 | Flora |
| 1,277,076 | A | | 8/1918 | Ireland |
| RE14,762 | E | | 11/1919 | Springer |

(Continued)

FOREIGN PATENT DOCUMENTS

| | | | |
|---|---|---|---|
| CA | 658135 | | 2/1963 |
| CA | 1177515 | A * | 11/1984 |

(Continued)

OTHER PUBLICATIONS

"Operators Manual Repair Parts List Automatic S350 Auto Air Tool", Band-it, A Unit of IDEX Corporation, 1999, pp. 1-38.

(Continued)

*Primary Examiner* — Robert J Sandy
*Assistant Examiner* — Michael Lee
(74) *Attorney, Agent, or Firm* — Sheridan Ross P.C.

(57) ABSTRACT

An improved band clamp is provided that employs a punch that forms an indication in the deformed band during locking procedure. More specifically, a punch having at least one shoulder or other indication mechanisms is provided that selectively contacts a band to deform it with respect to a buckle to lock the band and buckle of a band clamp together. The shoulder contemplated thus leaves a mark on the deformed band to quickly provide a visual indication of dimple depth.

13 Claims, 8 Drawing Sheets

U.S. PATENT DOCUMENTS 1,330,705 A 2/1920 Herrick
1,482,247 A 1/1924 Nowland
1,555,819 A 10/1925 Baruch
1,565,865 A 12/1925 Ragona
1,600,833 A 9/1926 McChesney
1,649,363 A 11/1927 Parsons
1,772,678 A 3/1928 Newton
1,670,201 A 5/1928 McGary
1,712,037 A 5/1929 Halter
1,849,784 A 3/1932 Birch et al.
1,887,732 A 11/1932 Pagel et al.
1,948,719 A 2/1934 King
1,973,823 A 9/1934 Monten
1,989,669 A 2/1935 Harvey
1,990,820 A 2/1935 Flader
2,007,002 A 7/1935 Porter
2,046,634 A 7/1936 Johnson
2,075,720 A 3/1937 Hoffmann
2,087,655 A 7/1937 Prestwich
2,115,736 A 5/1938 McAneny
2,118,158 A 5/1938 Ott
2,192,979 A 3/1940 McAneny, Jr.
2,208,114 A 7/1940 Campbell
2,208,134 A 7/1940 McAneny
2,210,510 A 8/1940 Sutton
2,214,110 A 9/1940 Ott
D123,270 S 10/1940 Mahn
2,312,400 A 3/1943 Govanus
2,312,575 A * 3/1943 McKee ..... 24/23 R
2,318,946 A 5/1943 Kass
2,324,609 A 7/1943 Watt et al.
2,349,608 A 5/1944 Bramble
2,426,731 A 9/1947 Elliot
2,536,536 A 1/1951 Childress et al.
2,551,384 A 5/1951 Middleton et al.
2,643,687 A 6/1953 Schlage et al.
2,837,494 A 6/1958 Gilbert et al.
2,870,503 A 1/1959 McAneny
2,871,738 A 2/1959 Abbiati
2,882,934 A 4/1959 Gerrard
2,928,434 A 3/1960 McAneny
2,967,550 A 1/1961 Rosenberger et al.
2,998,629 A 9/1961 Smith
3,015,865 A 1/1962 Rapuzzi
3,061,302 A 10/1962 Dennis
3,067,640 A 12/1962 Lodholm
3,014,256 A 12/1963 Derrickson et al.
3,112,496 A 12/1963 Drtiz
3,117,812 A 1/1964 Brooks et al.
3,152,621 A 10/1964 Meier
3,197,829 A 8/1965 Caveney et al.
3,241,579 A 3/1966 Partridge
3,242,542 A 3/1966 Tako
3,261,062 A 7/1966 Scarborough, Jr.
3,344,815 A 10/1967 Lawson et al.
3,552,450 A 1/1971 Plunkett
3,596,686 A 8/1971 Blumenfeld et al.
3,610,296 A 10/1971 Kabel
3,653,099 A 4/1972 Hoffman
3,660,869 A 5/1972 Caveney et al.
3,682,030 A 8/1972 Harris
3,735,784 A 5/1973 Obuch et al.
3,748,697 A 7/1973 Marchese et al.
3,754,303 A * 8/1973 Pollock ..... 24/23 W
3,782,426 A 1/1974 Morgan et al.
3,833,969 A 9/1974 Hollingsworth et al.
3,837,211 A 9/1974 Gress et al.
3,909,884 A 10/1975 Weckesser
3,964,133 A 6/1976 Wasserlein, Jr.
4,015,311 A 4/1977 Curtis
4,041,993 A 8/1977 Angarola
4,047,545 A 9/1977 Paradis
4,056,128 A 11/1977 Konrad
4,083,086 A 4/1978 Oetiker
4,091,511 A 5/1978 Reddy
4,106,799 A 8/1978 Oetiker
4,128,919 A 12/1978 Bulanda et al.
4,222,155 A 9/1980 Oetiker
4,272,870 A 6/1981 McCormick
4,333,210 A 6/1982 Burnett
4,366,602 A 1/1983 Conlon et al.
4,390,047 A 6/1983 Kaneko
4,399,592 A 8/1983 Chopp, Jr. et al.
4,418,448 A 12/1983 Sauer
4,450,032 A 5/1984 Wehr
4,473,925 A * 10/1984 Jansen ..... 24/23 W
4,492,004 A 1/1985 Oetiker
4,507,828 A 4/1985 Furutsu
4,567,626 A 2/1986 Kimbrough
4,570,340 A 2/1986 Shaw
4,607,867 A 8/1986 Jansen
4,631,782 A 12/1986 Gecs
4,646,393 A 3/1987 Young
4,646,591 A 3/1987 Jansen
4,696,327 A 9/1987 Wolcott
4,726,403 A 2/1988 Young et al.
4,733,701 A 3/1988 Loisel et al.
4,747,433 A 5/1988 Dixon
4,765,032 A 8/1988 Fortsch
4,793,385 A 12/1988 Dyer et al.
4,887,334 A 12/1989 Jansen et al.
4,896,402 A 1/1990 Jansen et al.
4,901,404 A 2/1990 Mizukoshi et al.
4,928,738 A 5/1990 Marelin et al.
4,934,416 A 6/1990 Tonkiss
4,947,901 A 8/1990 Rancour et al.
4,997,011 A 3/1991 Dyer et al.
5,000,232 A 3/1991 Wolcott
5,007,465 A 4/1991 Tonkiss
5,024,149 A 6/1991 Kato
5,123,456 A 6/1992 Jansen
5,127,446 A 7/1992 Marelin
5,129,350 A 7/1992 Marelin
5,146,847 A 9/1992 Lyon et al.
5,163,482 A 11/1992 Wolcott
5,203,786 A 4/1993 Vernick
5,251,360 A 10/1993 Putz
5,291,637 A 3/1994 Meyers
5,293,668 A 3/1994 Tibiletti
5,303,571 A 4/1994 Quinn et al.
5,322,091 A 6/1994 Marelin
5,452,523 A 9/1995 Jansen
5,483,998 A 1/1996 Marelin et al.
5,488,760 A 2/1996 Jansen
5,533,235 A 7/1996 Fukuda
5,566,726 A 10/1996 Marelin
5,628,348 A 5/1997 Scott et al.
5,644,819 A 7/1997 Lyons
5,647,563 A 7/1997 Gantner et al.
5,732,446 A 3/1998 Blanks
5,743,310 A 4/1998 Moran
5,850,674 A 12/1998 Jansen
6,014,792 A 1/2000 Marelin et al.
6,038,967 A 3/2000 Chak et al.
6,041,581 A 3/2000 Huber
6,122,804 A 9/2000 Gamaggio-Schafer
6,302,157 B1 10/2001 Deschenes et al.
6,457,212 B1 10/2002 Craig
6,615,879 B2 9/2003 Kurmis
6,668,427 B2 12/2003 Bulanda et al.
7,373,695 B2 5/2008 Caveney et al.
7,484,274 B2 2/2009 Nelson et al.
7,650,680 B2 * 1/2010 Stillings et al. ..... 29/521
7,866,007 B2 1/2011 DeBerry et al.
2006/0266230 A1 11/2006 Vereschagin
2006/0272133 A1 12/2006 Ingalls et al.
2007/0084022 A1 4/2007 Stillings
2009/0114308 A1 5/2009 Marelin

FOREIGN PATENT DOCUMENTS

CH 594821 1/1978
CH 663995 1/1988
DE 1268077 2/1962
DE 19805062 8/1999
EP 0174410 3/1986
EP 0479602 4/1992
EP 0479623 4/1992

| | | |
|---|---|---|
| EP | 0687528 | 12/1995 |
| EP | 0758616 | 2/1997 |
| EP | 0806349 | 11/1997 |
| EP | 1231140 | 8/2002 |
| EP | 1359357 | 11/2003 |
| EP | 1537800 | 6/2005 |
| GB | 932116 | 7/1963 |
| GB | 1025811 | 4/1966 |
| GB | 1030707 | 5/1966 |
| GB | 1068993 | 5/1967 |
| NL | 7408399 | 12/1975 |
| WO | WO 82/02035 | 6/1982 |
| WO | WO 96/27526 | 9/1996 |

OTHER PUBLICATIONS

IDEX Corporation, "Automatic Air Tool S350", p. 15, 2000, Band-It The Clamping Experts, Jul. 2000, pp. 1-4.

"IT9000 Bench Mounted Electric Tool Specifications", BAND-IT, The Clamping experts, date unknown, pp. 1-8.

"Simple Solution to a Complex Problem: Electro Adapter, Inc. Introduces CBS Calibrated Banding System", Electro Adapter, Inc. pp. 1-4.

"Yesterday, Today and Tomorrow Sunbank Meets the Challenge", Sunbank Electronics, Inc., pp. 1-4.

International Search Report for International (PCT) Patent Application No. PCT/US08/82271, mailed Dec. 29, 2008.

Written Opinion for International (PCT) Patent Application No. PCT/US08/82271, mailed Dec. 29, 2008.

Hogan, "Ball-Locking System secures stainless steel tie", Design News, Apr. 6, 1981, pp. 1-2.

"Scru-Band Scru-Seal™ Clamps Clamp-Pak™", BAND-IT® Catalog, pp. 18-19.

"Multi-Lok Ties: Self-Locking Multi-Lok Ties", p. 8.

Strapping, Stretch Wrapping and Tape Protection Packaging Systems Catalog, Signode, May 8, 2007, pp. 1-4.

"Steel Strapping, Seals and Tools", Certified Slings and Supply website, as early as 2006, available at http://www.certifiedslings.com/catalog/8-SteelStrappingSealsTools.shtml, printed on Apr. 16, 2009, pp. 1-2.

"Steel Strapping, Seals and Packaging Tools", Modern International Corporation website, as early as May 5, 2002, available at http://www.moderninternational.com/strapping/steel.htm, printed on Jun. 28, 2007, pp. 1-4.

International Preliminary Report on Patentability for (PCT) Patent Application No. PCT/US08/82271, mailed May 14, 2010.

Official Action for New Zealand Patent Application No. 585144, dated Jul. 7, 2011 2 pages.

Search Report for European Patent Application No. 08843376.8, mailed Nov. 24, 2011 8 pages.

Official Action with English translation for Russia Patent Application No. 2010122309/02(031735), dated Nov. 21, 2011 6 pages.

* cited by examiner

| | Lip Lock Prior Art | Band Clamp Embodiment 1 | Band Clamp Embodiment 2 |
|---|---|---|---|
| Material | 201 Stainless Steel | Galvanized Carbon Steel | Galvanized Carbon Steel |
| Lubrication | Oil | Oil | PEG |
| Buckle | Traditional* | Slit-edged**,.125 hole punched thru all, formed top | Slit-edged**,.125 hole punched thru all, formed top |
| Tension Applied | 100psi | 350lb | 300lb |
| Samples | 30 | 23 | 30 |
| Avg. Retained Force (lbf) | 335 | 472 | 664 |
| Avg. Max Clamping (lbf) | 496 | 670 | 903 |
| St. Dev. (lb) | 72% | 70% | 73% |
| % Retained | 26 | 46 | 48 |
| Avg. Loop Tensile Force (lbf) | 778 | 1151 | 985 |
| St. Dev. (lb) | 59 | 76 | 31 |
| Failure Mode | Pull thru | Multiple points | Multiple points |

*Deburred, no aperture made of 201 Stainless Steel.
**Slit-edge refers to a raw, burred edge.

*Fig. 16*

| | Lip Lock Config 1 | Lip Lock Config 2 | Band Clamp Embodiment 1 | Band Clamp Embodiment 2 | Band Clamp Embodiment 3 |
|---|---|---|---|---|---|
| Band | .019 201SS | .019 GCS* | .25 x .019 201SS | .25 x .019 201SS | .25 x .019 GCS* |
| Buckle | Traditional** | Traditional** | .125 hole thru all, traditional** | .125 hole thru all, slit edge***, v-shaped indent | .125 hole thru all, slit edge*** |
| Samples | 30 | 3 | 10 | 3 | 4 |
| Retained Force (lbf) | 203 | 355 | 434 | 421 | 513 (250%) |
| Max Clamping (lbf) | 417 | 514 | 598 | 575 | 619 |
| % Retained | 49% | 69% | 73% | 73% | 84% |
| Variation | 4% | 0.4% | 1% | 1% | 2% |
| Loop Tensile (lbf) | 750 | 662 | 1394 | 1640 (220%) | 1213 (160%) |
| Variation | 3% | 1% | 1% | 3% | n/a |
| Failure Mode | Pull thru | Pull thru | Pull thru | Pull thru | Band breaks at thru hole |

* Galvanized Carbon Steel
** Deburred, no aperture made of 201 Stainless Steel.
*** Slit-edge refers to a raw, burred edge.

*Fig. 17*

DUAL LOCKING BAND CLAMP AND METHOD OF FORMING THE SAME

CROSS REFERENCE TO RELATED PATENTS

This application claims the benefit of pending U.S. Provisional Patent Application Ser. No. 60/985,142, filed Nov. 2, 2007, the entire disclosure of which is incorporated by reference herein. This application is also related to U.S. Pat. No. 5,483,998, issued Jan. 16, 1996, U.S. Pat. No. 6,014,792, issued Jan. 18, 2000, U.S. Pat. No. 5,123,456, issued Jun. 23, 1992, and U.S. Patent Publication No. 2007/0084022, filed Oct. 17, 2005, the entire disclosures of which are incorporated by reference in their entirety herein.

FIELD OF THE INVENTION

Embodiments of the present invention are generally related to band clamps that include a buckle for interconnection to a band wherein a portion of the band is threaded through the buckle and secured thereto to bundle items together or to affix one item to another.

BACKGROUND OF THE INVENTION

Band clamps are widely used in a variety of applications. Band clamps generally include a band which is formed into a loop around an object, such as a pole or other object, and a buckle that receives the opposing end of the band. The band and buckle cooperate to lock the band in a fixed position relative to the buckle. Tools are employed to tighten the band around one or more objects, secure or lock a free end of the band relative to a buckle or locking member, and cut any excess portion of the band. Typically, these tools grasp the free end of the band after it has passed through the buckle and apply a force to the free end of the band while simultaneously maintaining the position of the buckle to tighten the band around one or more objects. Once an appropriate tension is applied to the band, the tool will create the desired locking geometry in the band and/or buckle and shear the portion of the free end of the band extending beyond the buckle. Typically, a blade performs the shearing or cutting operation.

Tools that perform the tightening, locking and cutting functions are primarily manual, pneumatic or electric in nature. In the case of pneumatic or electric tools, limited or reduced physical effort is required by the operator as compared to most manual tools. Band tightening tools that are pneumatic or electric are usually semiautomatic in that the operator of such a tool is required to perform some, but not all, of the tasks or functions associated with providing a band clamp about an object. Manual tasks that remain may include locating the band, or tie as it is sometimes called, about the object and inserting or otherwise locating the band clamp relative to the tool so that the tool can perform one or more of its tightening, locking and cutting functions.

Band clamps of the prior art have certain drawbacks. For example, there is a need for improving loop tensile force (the force required to break the band or the lock) other than by simply increasing the physical size of the band and buckle. Also, there is a need for improving the percentage of retained force (the residual force in the band after forming the lock). Stated differently, there is a need to reduce or eliminate the tensile load that is lost following formation of the lock and release of the band by the tool. For a number of reasons, including tolerances and imprecise metal forming techniques, once the tool cuts the free end of the band, a portion of the band tends to slip back through the buckle expanding the circumference of the band. As a result, a portion of the retained tensile load is lost and the percent retained force decreases. The formed lock may also relax or loosen over time, causing the band circumference to expand, particularly if the outward force applied on the band by the constrained objects is large or if the band and buckle are subjected to external forces such as vibration or other motion causing relative motion of the band and buckle. Still further, there is a need in some applications to increase the clamping force (the maximum force reached just prior to the band tightening tool cutting off the excess end of the band). The clamping force is related to the retained force. Typically, the higher the clamping force, the higher the retained force.

In addition to the foregoing problems, other considerations are relevant in designing a band clamp. First, the band clamp should have a high tensile strength to resist the outward tensile force exerted thereon by the constrained object or objects. Second, the band clamp should be inexpensive to manufacture. Band clamps are used in a variety of applications where cost is a concern. Thus, simply increasing the physical size of the band clamp does not address all of the design considerations, including cost constrictions. A physically larger band clamp will have a greater loop tensile force, but it will cost more. In addition, the band clamp should be simple in design and easy to use.

SUMMARY OF THE INVENTION

It is one aspect of the present invention to provide a band clamp that is comprised of a band and a buckle and that employs a dual locking feature. More specifically, embodiments of the present invention employ a lip lock and a dimple lock to secure the band around an object or objects. "Lip lock" as used herein refers to a system of bending a portion of the band around an edge of the buckle, thereby fixing the band relative to the buckle. "Dimple" or "Dimple lock" as used herein refers to a system wherein a portion of the band is deformed into an aperture formed in a different portion of the band to maintain the circumference of the band. One of skill in the art will appreciate that the deformation may also interface with the buckle to fix the band relative to the buckle. Traditionally, a lip lock or dimple lock is used exclusive of the other. Embodiments of the present invention combine these two locking methods to yield a band clamp with enhanced performance related to retained force, maximum clamping force, average loop tensile force, etc.

It is another aspect of the present invention to control retaining force, strength and long term reliability of a band clamp described herein by adjusting the depth and/or location of the dimple relative to the portion of the band that receives the dimple and relative to the buckle.

It is another aspect of the present invention to provide a band clamp that allows for visual inspection of the dimple quality. In one embodiment, a dimple lock is formed by forcing a punch through an aperture in the buckle to deform the band positioned within the buckle and to create the dimple that locks the band relative to a different portion of the band and relative to the buckle to generally fix the circumference of the band as well as prevent substantial movement of the band relative to the buckle. However, if any or all of the punch, band or buckle are mispositioned, the dimple may be misformed, which can reduce the quality or performance of the dimple lock. Thus it is contemplated that the punch used to form the dimple in the band include an outwardly extending shoulder such that when a dimple is properly made, a ring, visually flat surface or other indicator will be formed in the band adjacent to at least a portion of the perimeter of the dimple. For example, a ring formed completely around the perimeter of the dimple provides a visual indication that the dimple was formed to a proper predetermined depth and at a proper angle relative to the band.

It is yet another aspect of the present invention to provide a locking system that is stronger than the band material. More specifically, the failure mode of prior art band clamps exposed to an expansive force is typically associated with the locking feature of the buckle. For example, band clamps generally fail when the locking lip yields which allows the band to slip relative to the buckle. Alternatively, in the case of a dimple lock, the dimple may simply rupture or shear off also enabling the band to slacken. This can happen because the overlapping layers of band material separate, because the metal forming the dimple is too thin, for both of these reasons, or for other reasons known to those of skill in the art. Embodiments of the present invention include an enhanced locking feature wherein the dimple and lip lock are used in combination to provide an interlocking mechanism that is stronger than the band. Thus the integrity of the locking scheme is enhanced such that the band will deform or fail before the locking features. This failure mode is very predictable since the yield and ultimate stresses of the band are well known. Slackening of the band or complete release due to dimple failure and/or lip deflection is less predictable. However, the visual indicator of dimple quality, referenced previously, will improve prediction of dimple failure.

Often thieves and vandals wish to remove band clamps in order to obtain the items the band clamps are constraining or supporting. For example, often band clamps secure signage, lights or other objects onto poles. These items are often pilfered to later be used as decorations or sold. The lip lock of embodiments of the present invention possess a redundant locking scheme wherein if one lock is circumvented, the other lock will retain the band clamp.

It is another aspect of the present invention to provide a buckle that allows for reduction in friction during integration of the band into the buckle. More specifically, as will be apparent to one skilled in the art, synching of a band within a buckle often places side edges of the band in contact with side portions of the buckle. As the band is transitioned through the buckle friction will result, thereby wasting energy that would alternatively be associated with tightening the band. In addition, the band may scrape the inner portion of the buckle as it is synched which may create metal filings that could harm individuals and damage tools. Thus, embodiments of the present invention employ a buckle having a slot formed between a pair of legs wherein the slot and the space between the edges of the buckle legs is increased to a dimension wider than the width of the band. The added space reduces contact and friction between the band and the buckle during tightening. In one embodiment of the present invention a tool is used to create an offset in an upper portion of the buckle wherein material is pushed downwardly to force the legs outwardly to provide the additional space.

It is another aspect of the present invention to provide a cable tie that has decreased friction to further increase the efficient use of energy during tightening and clamping. More specifically, bands of embodiments of the present invention are coated with a lubricant, preferably polyethylglycol (PEG). The preferred lubricant is environmentally friendly, as opposed to oil that is generally used. Lubricant influences the interaction between layers of a wrapped band. For example, the less lubrication, the greater the loop tensile force due achieved to the interaction of adjacent band layers that resist motion that would tend to relax the wrapped band. Lubrication, however, PEG also increases the clamping force, retained force and performance repeatability associated with the cable tie by facilitating band/buckle interconnection. Lubrication will reduce energy-wasting frictional interactions between the band and buckle during tensioning and cutting the band. That is, decrease in friction between the band and the buckle translates into more energy that can be applied to clamping force. Lubrication, such as PEG, also extends the shelf life of the band clamps compared to oil-based lubricants that evaporate over time.

It is also an aspect of the present invention to provide a buckle that increases the locking performance of the lip lock. More specifically, embodiments of the present invention include a buckle having a generally 90° edge that engages the portion of the band that forms the lip lock. In this way, the interface between the buckle and the band is a linear edge of the buckle that increases the retaining force compared to band clamps without this feature. Preferably, a "slit-edge" is employed, i.e., an edge that has not been deburred or otherwise machined. Such edges are sharp and dig into the lip to facilitate locking.

It is also an aspect of the present invention to provide a band clamp that possesses a combination of strength, longevity and cost effectiveness by optimizing materials used. More specifically, embodiments of the present invention employ galvanized carbon steel, stainless steel or any alloy.

It is another aspect of the present invention to provide a low profile buckle shape that easily fits in to tight spaces.

It is another aspect of the present invention to provide a band clamp that maintains retained force. More specifically, the band relaxation generally associated with the formation of a lip lock is greatly reduced by the presence of the dimple lock. To form a lip lock the band must be cut while under tension. In one embodiment, the blade that severs the band forms the curl or lip by bending the band as part of the cutting operation. In the time between these two actions, which may be very small, the band is able to move relative to the buckle. The presence of the dimple greatly reduces this slackening effect.

BRIEF DESCRIPTION OF THE DRAWINGS

The accompanying drawings which are incorporated in and constitute a part of the specification, illustrate embodiments of the invention and together with a general description of the invention given above and the detailed description of the drawings given below, serve to explain the principles of invention.

FIG. 16 is a chart of performance of a band clamp of one embodiments of the present invention; and FIG. 17 is a chart of performance test data.

Figure 1:
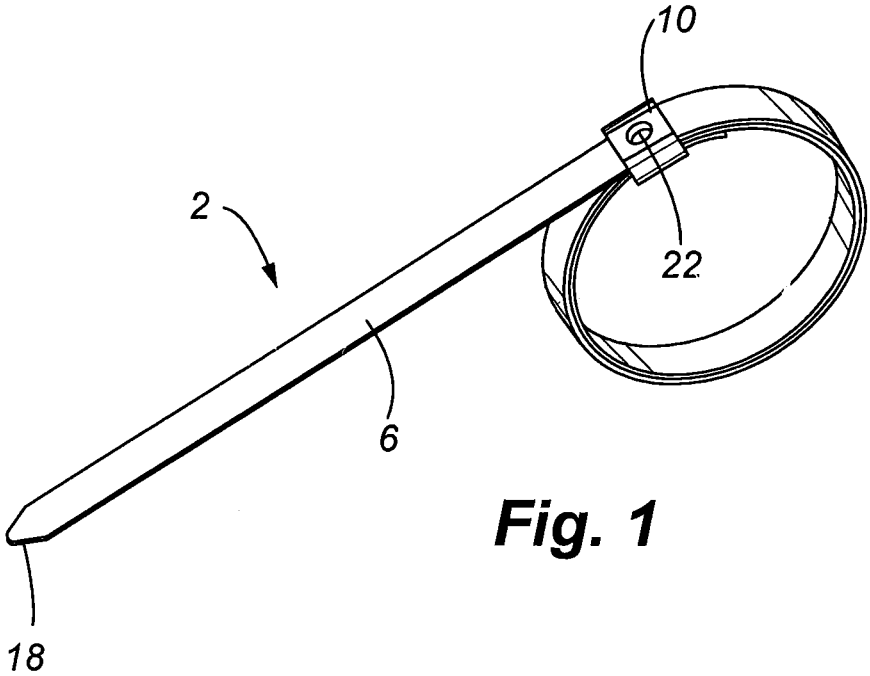
FIG. 1 is a perspective view of a band clamp of one embodiment of the present invention.
Figure 2:
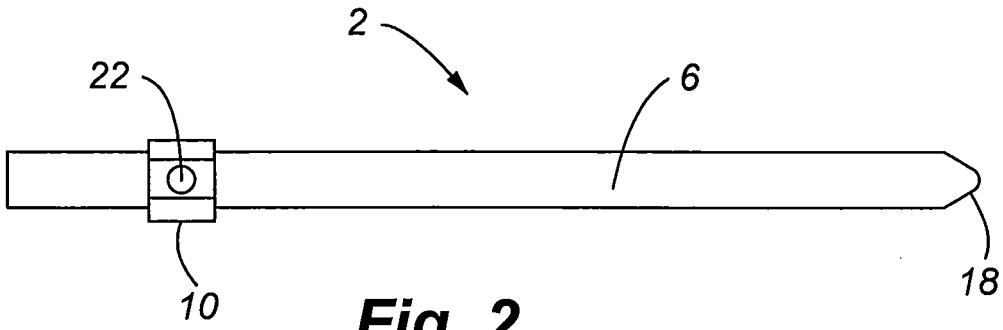
FIG. 2 is a top elevation view of FIG. 1.
Figure 3:
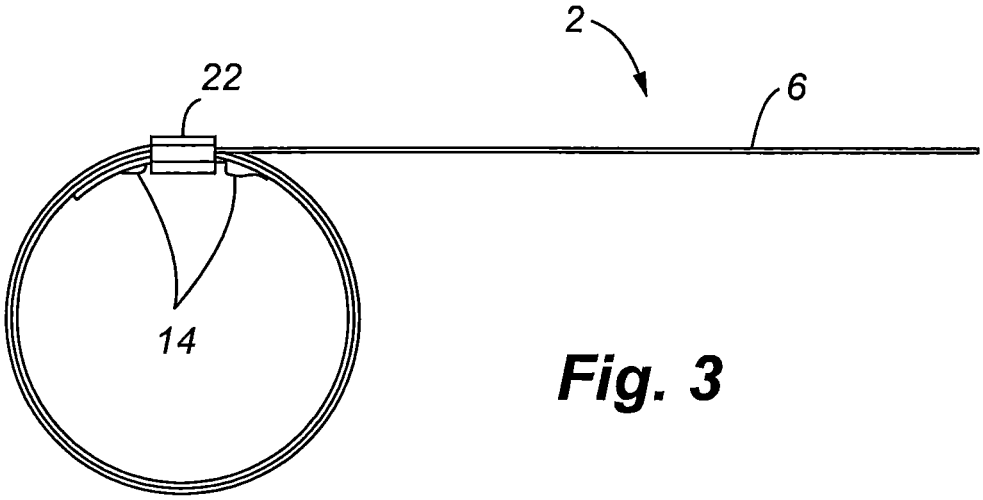
FIG. 3 is a front elevation view of FIG. 1.
Figure 4:
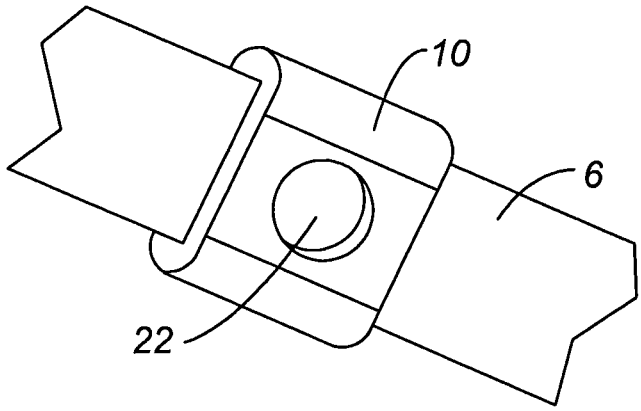
FIG. 4 is a detailed view of the buckle.

While the following disclosure describes the invention in connection with those embodiments presented, one should understand that the invention is not strictly limited to these embodiments. Furthermore, one should understand that the drawings are not necessarily to scale, and that in certain instances, the disclosure may not include details which are not necessary for an understanding of the present invention, such as conventional details of fabrication and assembly.

DETAILED DESCRIPTION

Referring now to FIGS. 1-4, one embodiment of a band clamp 2 commonly used in the art comprised of a band 6 with a buckle 10 positioned thereon is shown. The band 6 may also include at least one obstruction 14 to maintain the position of the buckle 10 on the band 6. The obstruction 14 may be in the form of dents or tabs formed in the band that engage the buckle to hold it into place. In operation, an end 18 of the band 6 is wrapped around the items being bundled and through the buckle 10. In some instances, the band 6 is wrapped multiple times about the items being bundled wherein the buckle 10 receives multiple overlapping band portions. Thereafter, a tool, i.e., punch, is used to deform the band 6 through an aperture 20 of the band 6 and, in some embodiments, through an aperture 22 of the buckle 10, thereby fixing the circumference of the band 6. The band 6 may include preformed obstructions 14 and an aperture(s), or the tool that is used to tension, deform and cut the band 6 may form these features.

Figure 5:
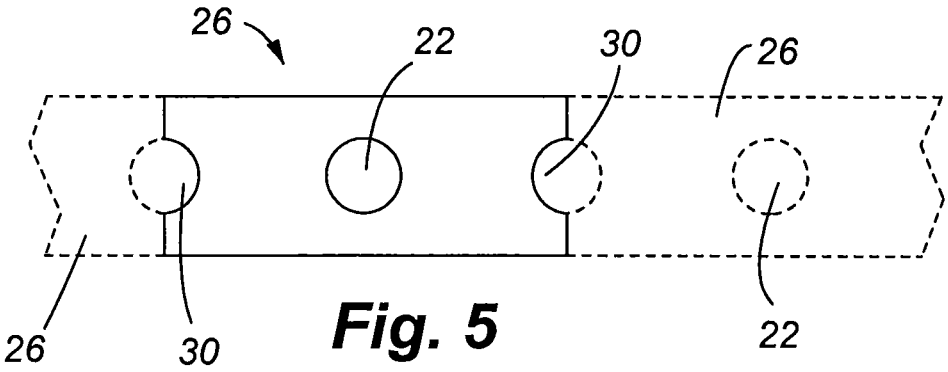
FIG. 5 is a top plan view of an unformed buckle.
Figure 6:
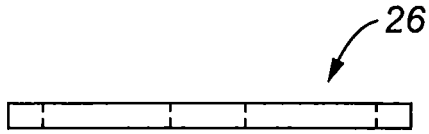
FIG. 6 is a front elevation view of FIG. 5.
Figure 7:
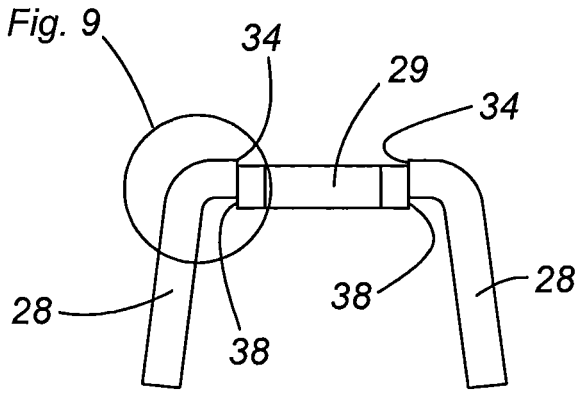
FIG. 7 is a front elevation view of a partially formed buckle.
Figure 8:
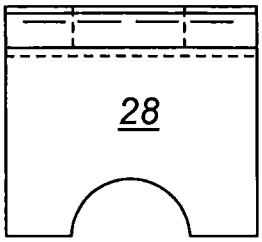
FIG. 8 is a side elevation view of FIG. 7.
Figure 9:
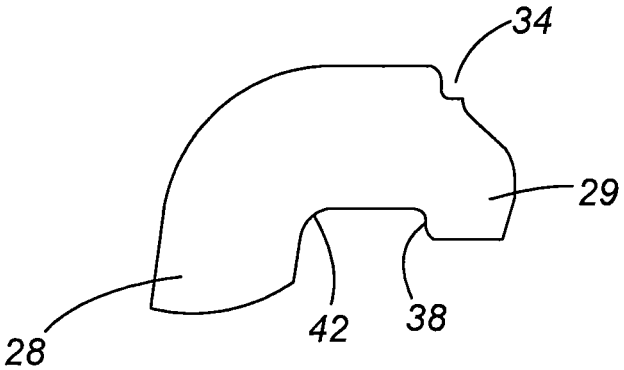
FIG. 9 is a detailed view of FIG. 7 showing a shoulder portion of the buckle.
Figure 10:
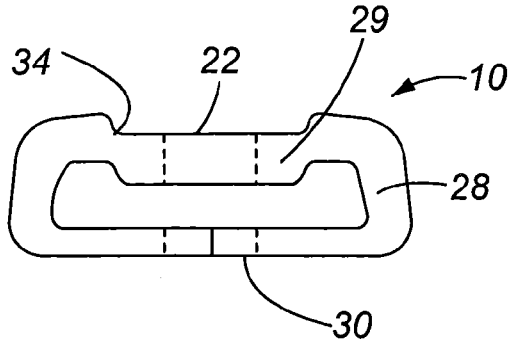
FIG. 10 is a front elevation view of a fully formed buckle.

Referring now to FIGS. 5-10, the buckle 10 of embodiments of the present invention is shown. Here, the undeformed buckle 26 begins as sheet stock, wherein an aperture 22, or portions thereof, are formed therein (FIG. 5). The sheet stock is then cut into discrete lengths to form the undeformed buckle 26 (FIG. 6) that is subsequently bent to form legs 28 on either side of a center portion 29 (FIG. 7). A second aperture 30 is formed when the legs 28 are bent inwardly to form a generally rectangular shape (FIG. 10). In order to facilitate insertion of the band within the buckle, embodiments of the present invention include a deformed or offset center portion 29 (FIG. 7). The center portion 29 is formed by compressing the undeformed buckle 26 (FIG. 6) which splays or forces the legs 28 outwardly to a predetermined angle. With specific reference to FIG. 9, the deformation process forms a shoulder 34 and an associated offset 38 in the center portion 29 of the buckle 10. The center portion 29 does not need to be continuous, it may be angled to a v-shape. The offset 38 formed at the interior of the buckle prevents the edges of the band from substantially contacting the inside corner 42 of the buckle (formed at the junction of the leg 28 and upper portion of the buckle). This structure provides the advantage of spacing the edges of the band from the sides of the buckle during band tensioning, which reduces interactions therebetween.

Figure 11:
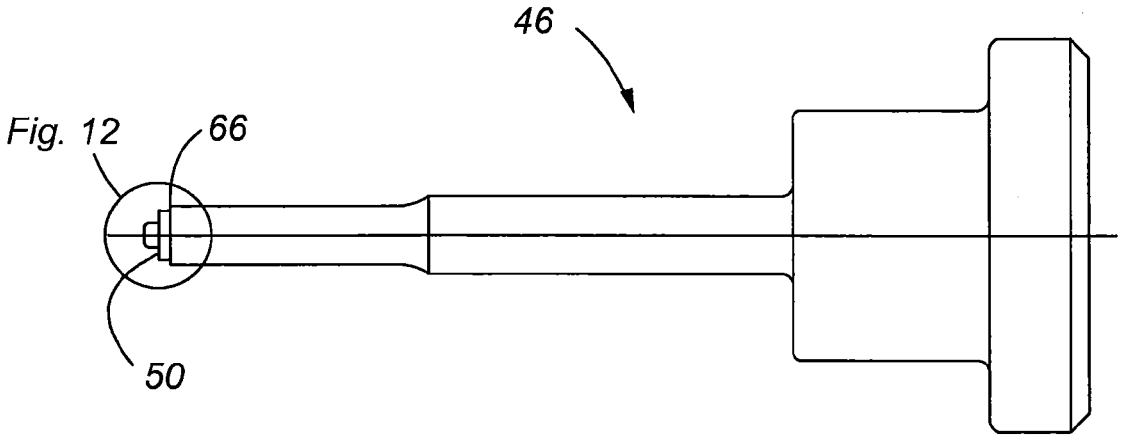
FIG. 11 is a front elevation view of a punch of one embodiments of the present invention that form a dimple in a band.
Figure 12:
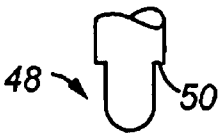
FIG. 12 is a detailed view of a tool similar to that shown in FIG. 11.
Figure 13:
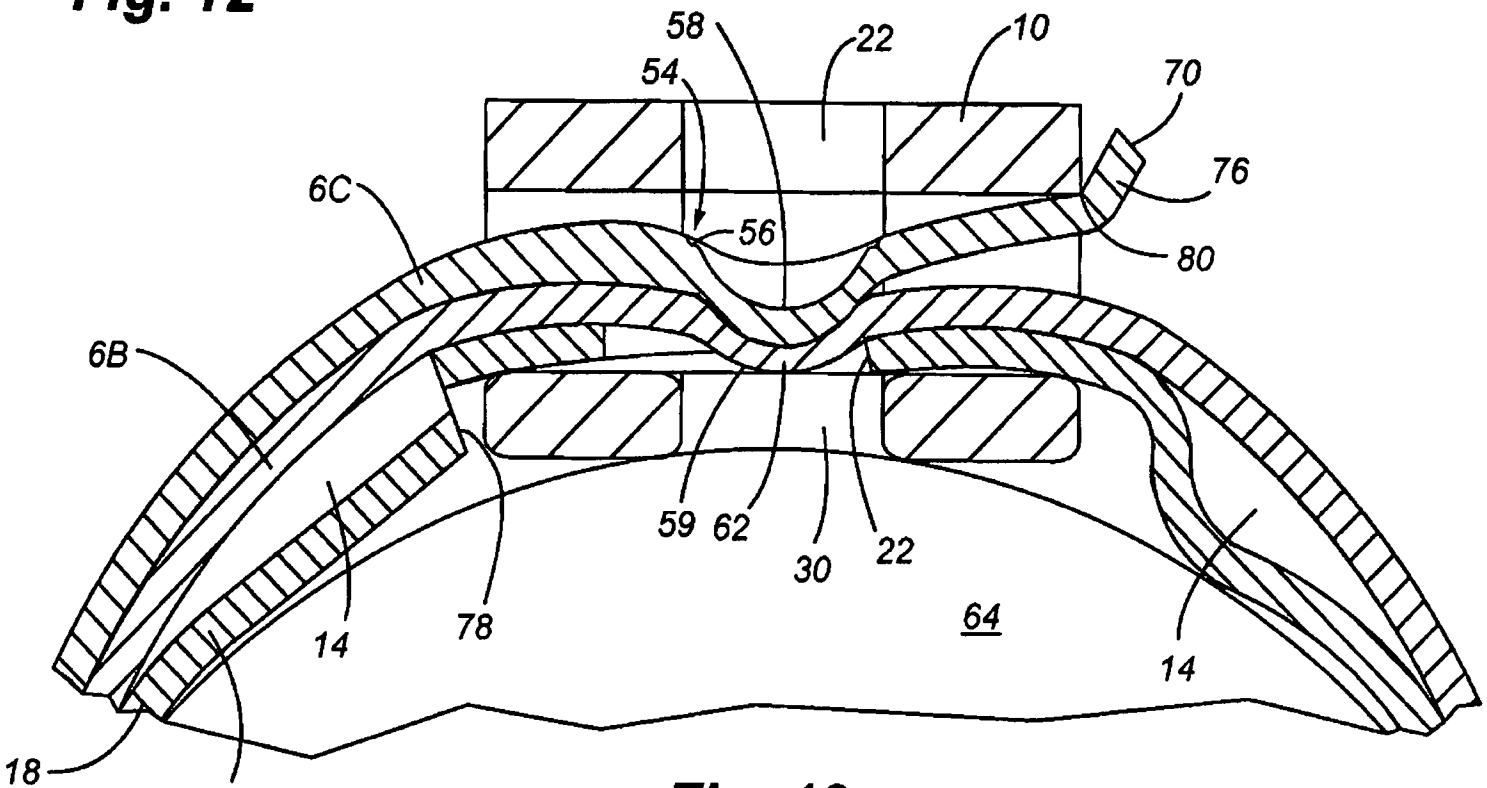
FIG. 13 is a cross-sectional view of a buckle and deformed band.
Figure 14:
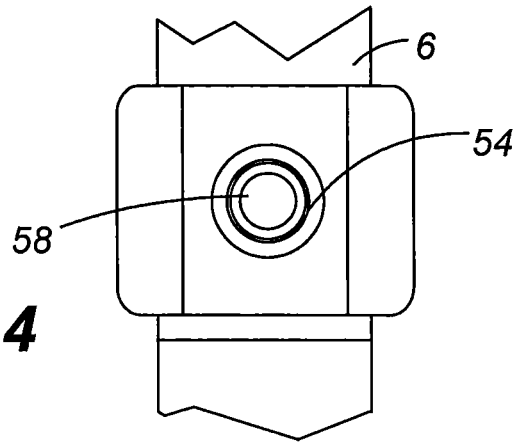
FIG. 14 is a top plan view of FIG. 13.

Referring now to FIGS. 11-14, a punch 46 and resulting band deformation, or dimple, is shown. An end 48 of the punch 46 includes at least one shoulder 50. FIG. 12 shows an end 48 having a single shoulder 50. FIG. 11 shows an end 48 having a plurality of shoulders 50, 66 which will be described below. With reference to FIG. 14, the shoulder 50, when positioned and aligned correctly relative to the band 6 will form a ring 54 about the punched area 58 of the band 6 to indicate that the dimple 62 was formed at the proper depth and angle relative to the band 6. More specifically, often a preselected punch depth and orientation is required to optimize the looped tensile strength of the band and buckle. Too shallow of a deformation 58 may allow the dimple to pull out of the aperture and the band 6 to slacken. Conversely, a deformation that is too deep may cause localized weakening or thinning in the dimple 6, thereby increasing the probability that the dimple 62 will be sheared off of the band 6.

The shoulder 50 will form an indentation in the outer surface of the band that extends around at least a portion of the outer surface of the dimple 62 which provides a visual indication of the proper punch depth and orientation. Preferably, the indentation forms a continuous ring 54 defined by a ridge 56 formed around the punched area 58 and above the lowest portion 59 of the deformation 58. The ridge signals a well-formed or quality dimple. Alternatively, still other embodiments of the present invention may employ a plurality of shoulders, (see FIG. 11) for example, a second shoulder 66, to provide an indication of minimum and/or maximum punch depth. That is, the first shoulder 50 will leave a mark 54, establishing that a minimum depth of dimple was achieved. However, if the second shoulder 66 also leaves a mark, one can quickly ascertain that the dimple 62 is formed too deep and the force applied by the punch 46 may require adjustment. The shoulder 50 also indicates that the dimple 62 was formed perpendicularly or at an angle. For example, the shoulder marking 54 will not be symmetric if the punch 46 strikes the band 6 at an angle. A dimple not formed substantially perpendicular to the opening 30 in the buckle is more susceptible to failure. Preferably, the dimple 62 that creates an ideal locking of the band is formed by a punch that strikes the band 6 generally perpendicularly.

Referring now to FIG. 13, the buckle 10 and band 6 are shown mechanically interconnected in at least two ways. Here, the punch has deformed 58 a portion of the band 6 which forces an adjacent under-wrapped portion of the band 62 downwardly to form the dimple 62. If made correctly, the dimple is forced into an aperture 22 of the band, thereby securing the perimeter or circumference of the band. In addition, the band is bent 76 upwardly and cut 70. The bend 76 contacts an edge 80 of the buckle 10 to form the lip lock. Preferably, the edge 80 is rough, wherein burs have not been removed, in order to facilitate an engagement between the buckle 10 and band 6. The interaction of the relatively sharp edge 80 and the bend 76 contribute to the desire retention force of the band clamp.

In operation, a band 6 having a buckle 10 associated therewith is positioned adjacent to a light pole 64 or other items being bundled. The buckle 10 is captured by obstructions or nests 14 that are positioned a slight distance apart on the same side of the band to maintain the position of the buckle on the band. Examples of such nests may be found in FIG. 10 of U.S. Pat. No. 6,014,792. The end 18 of the band is positioned adjacent to the light pole 64 wherein a first wrap **6*a* is created around light pole. There after, at least one other wrap 6*b* is positioned around the initially placed wrap 6*a*. In this example, however, a third wrap 6*c* is wrapped around the first wrap 6*a* and second wrap 6*b* of the band. While the band 6 is under tension, a tool deforms 58 a portion of the band to form a dimple 62 and to also cut and bend 76 the band, as described above. The punch forms a dimple 58 in the third wrap 6*c* that also deforms the underlying second wrap 6*b* into the aperture 22 formed in a portion of the first layer of band, thereby locking the circumferential dimension of the band. Depending on the desired dimple depth, a portion of the third wrap 6*c* may also be deformed such that it extends into the aperture 22. The dimple 62 may also be formed through an aperture 30 of the buckle that is positioned beneath the aperture 22 of the band 6***a*. In some cases both wraps have portions that are positioned within the aperture 30 of the buckle. In addition, one will appreciate that a single wrap may be formed wherein a greater portion of that wrap is positioned within aperture 30 of the buckle.

With respect to the lip lock, the buckle 10 is locked relative to the band by way of an interaction between the bend 76 and a face 78 of the nest 14. More specifically, expansive forces applied to the inner-diameter of the wrapped band are counteracted by compressive forces acting on the band that are generated by the bend 76 and the face 78.

Figure 15:
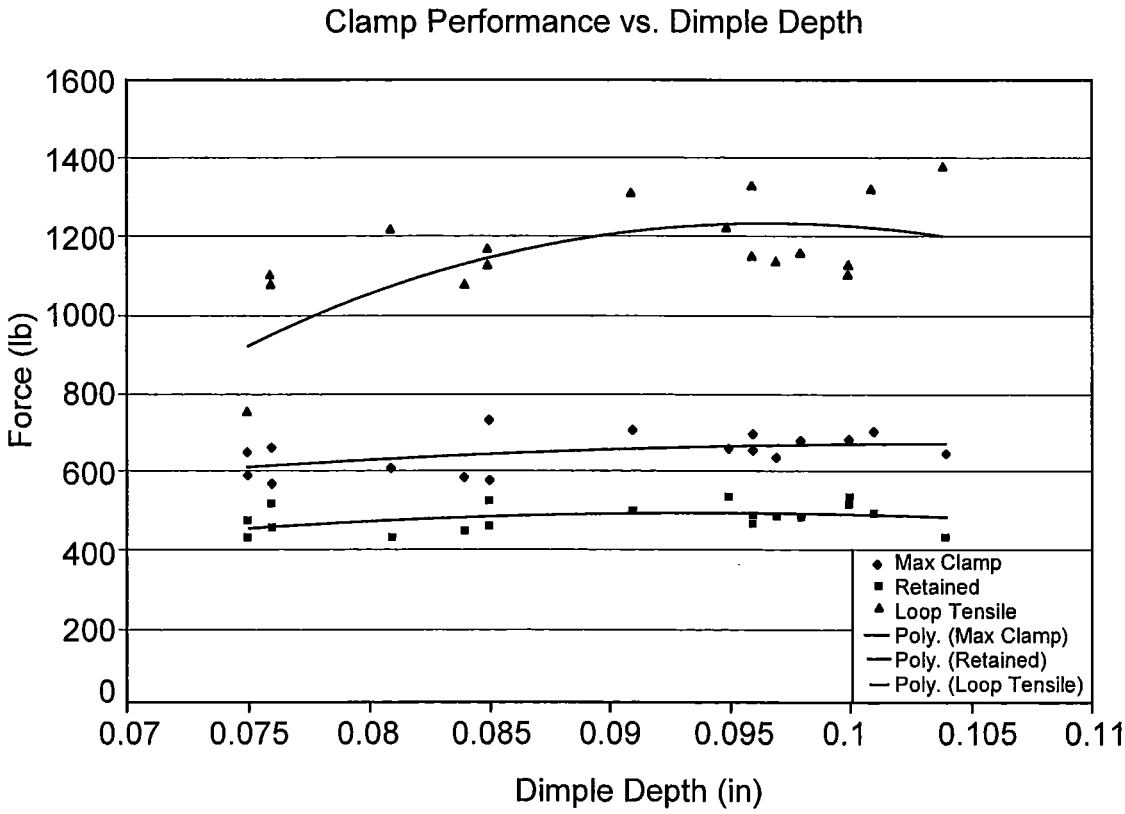
FIG. 15 is a chart showing performance versus dimple depth of a band clamp of one embodiment of the present invention.

Referring now to FIG. 15, a graph showing band clamp performance versus dimple depth is provided. More specifically, the dimple depth may be optimized to provide a desired clamp performance. Here, one skilled in the art will appreciate that the tensile force provided by embodiments of the present invention, which is the allotted force it would take to make the band fail after it has been buckled, increases when the dimple is about 0.0955 inches in depth. Thereafter, it decreases slightly. The maximum clamping force, i.e. the force provided by the cable tie, increases steadily depending on the dimple depth. Finally, the retained force, i.e. the force after cutting of the excess of the band and after relaxation of the band, is maximized between about 0.09 and 0.095 inches of dimple depth. The band tested to generate the data shown in FIG. 15 was about 0.25 inches wide by 0.020 inches thick and made of galvanized carbon steel. Similar data is achieved for clamps of other sizes. That is, it was found that the width and thickness of the band was not a deciding factor in the performance of the clamp. The driving factor is the depth of the dimple.

Referring now to FIG. 16, a table of band clamp performance of embodiments of the present invention is shown. FIG. 16 shows data related to a comparison of a band clamp only employing a lip lock versus band clamps of embodiments of the present invention that employ a dimple lock and lip lock. Embodiment 1 employed a band made of galvanized carbon steel that has been oiled. Embodiment 2 employed a band made of galvanized carbon steel coated with PEG. The test clamps used traditional or slit edge buckles. A "traditional" buckle possesses smooth, deburred edges, whereas a "slit-edge" refers to a buckle that has not been substantively machined or polished after construction that possesses a rough, burred edge. As can be appreciated by review of the table, by combining a lip and dimple lock as provided by Embodiments 1 and 2, the average retained force is dramatically increased as is the average maximum clamping force and average loop tensile force. The percent retained force, however, remains substantially the same. The prior art band clamps that were tested were stressed to failure wherein the lip lock, predictably, failed when the bend deformed to allow the band to slip relative to the buckle. Conversely, the band clamps of the present invention (Embodiments 1 and 2) failed at multiple points wherein the dimple and other portions of the band failed simultaneously.

Referring now to FIG. 17, a table shows data comparing embodiments of the present invention to embodiments solely using lip locks. Again, bands solely employing lip locks (Configurations 1 and 2) were tested and compared with those employing aspects of the present invention (Embodiments 1-3). Lip lock Configurations 1 and 2 employed bands that were either made of stainless steel or galvanized carbon steel. Both lip lock configurations employed a traditional band, a buckle that is deburred having no apertures and made of 201 stainless steel. Three embodiments of the present invention were each constructed with either stainless steel or galvanized carbon steel. Those embodiments either used a buckle of traditional construction or of a slit edge construction. In addition, the band clamp of Embodiment 2 employed a v-shaped indent, similar to that shown in FIGS. 7 and 9. Review of the data will show, for example, that the buckle/band combination employing a slit edge (Embodiments 2 and 3) has a greater loop tensile strength than the prior art band clamp (Configurations 1 and 2) that employ a traditional buckle. All the embodiments of the present invention have an increased percent retained force over that of the bands that solely employed a lip lock. With reference to Embodiment 3 shown in FIG. 17, the failure mode is different than the remainder of the test subjects. More specifically, during failure the band brakes at the through hole, i.e., the dimple is severed from the band. This is a result of the slit-edge lip lock which produces an enhanced engagement between the band and the buckle helps prevent the band from deflecting to a orientation where it can slip through the buckle. The data provided is associated with band clamps that were double wrapped about a testing mandrill. One skill in the art will appreciate that the use of a dual lock as described herein is not limited to a band of these dimensions and of the compositions shown. That is, the band and buckle may be scaled and sized, use other materials, etc.

The foregoing discussion of the invention has been presented for purposes of illustration and description. The foregoing is not intended to limit the invention to the form or forms disclosed herein. In the foregoing description for example, various features of the invention have been identified. It should be appreciated that these features may be combined together into a single embodiment or in various other combinations as appropriate for the intended end use of the band. The dimensions of the component pieces may also vary, yet still be within the scope of the invention. This method of disclosure is not to be interpreted as reflecting an intention that the claimed invention requires more features than are expressly recited in each claim. Moreover, though the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation. Rather, as the following claims reflect, inventive aspects lie in less than all features of any single foregoing disclosed embodiment. Thus, the following claims are hereby incorporated into this Detailed Description, with each claim standing on its own as a separate preferred embodiment of the invention.

What is claimed is:

1. A locked band clamp, comprising:

a buckle including an opening therethrough for receiving a band, said buckle also including an aperture through an outer surface of said buckle;

a band positioned within said buckle;

a deformation formed in the band located generally adjacent to said aperture, said deformation preventing relative motion between said band and said buckle;

a curled portion of said band that engages an edge of said outer surface of said buckle that prevents relative motion of said buckle relative to said band; and a visual indicator formed in the band at least partially around said deformation, said visual indicator comprised of an indention in the outer surface of the band that forms a ridge that is located above a lowest portion of said deformation.

2. The locked band clamp of claim 1, wherein said buckle comprises a second aperture in a bottom surface of said buckle, which is spaced from said aperture, that receives a portion of said deformation.

3. The locked band clamp of claim 1, wherein said band includes at least one obstruction that restricts relative motion between said buckle and said band in addition to said deformation and said curled portion.

4. The locked band clamp of claim 1, wherein said deformation is formed in said band by a punch that travels at least partially through said aperture, the punch comprised of a shaft with a proximal end and a distal end, the proximal end associated with a band clamping tool and the distal end being adapted to contact and deform a portion of said band to form said deformation, the punch also having an increased diameter portion adjacent to said distal end that forms a visual indication of the quality of the deformation in said band when the distal end is forced into said band by the tool.

5. The locked band clamp of claim 4, further comprising a second increased diameter portion positioned adjacent to the increased diameter portion that forms a second visual indication of quality of the deformation in said band when the distal end is forced into said band by the tool to a predetermined depth.

6. The locked band clamp of claim 1, wherein said buckle is comprised of a center portion the includes said aperture, a first leg interconnected to said center portion along a first lateral edge, and a second leg interconnected to said center portion along a second lateral edge, said center portion being offset from said first leg and said second leg such that a left shoulder and a right shoulder are formed in said outer surface.

7. The locked band clamp of claim 1, wherein said deformation is between about 0.095 to about 0.1 inches deep.

8. The locked band clamp of claim 1, wherein said visual indicator is a ring that extends around said deformation.

9. The locked band clamp of claim 2, wherein said band is wrapped about an object at least two times to form an inner wrapped portion and an outer wrapped portion, and said deformation is a dimple formed into said outer wrapped portion of said band that contacts said inner wrapped portion to form a second deformation in said inner wrapped portion of said band that extends into said second aperture, of said buckle.

10. The locked band clamp of claim 3, wherein said at least one obstruction comprises a first indentation formed adjacent to a first end of said band and a second indentation formed in said band that is spaced from said first indentation to thereby provide a space for receiving said buckle.

11. The locked band clamp of claim 8, wherein said ring has a diameter that is less than the diameter of said aperture of said buckle.

12. The locked band clamp of claim 1, wherein said ridge is formed by a shoulder of a punch that is forced into said band to form said deformation.

13. The locked band clamp of claim 12, wherein said shoulder forms a continuous ridge around said deformation.

* * * * *